US007674086B2

(12) United States Patent
Schmidt-Hebbel et al.

(10) Patent No.: US 7,674,086 B2
(45) Date of Patent: Mar. 9, 2010

(54) METHOD AND APPARATUS FOR HANDLING ROLLS FROM PAPER OR TISSUE MAKING MACHINE WITHOUT TOUCHING THE ROLL SURFACE

(75) Inventors: Harald Schmidt-Hebbel, Aldeia da Serra (BR); Gerald Kramer, Rockton, IL (US)

(73) Assignee: Voith Andritz Tissue, LLC, Janesville, WI (US)

( * ) Notice: Subject to any disclaimer, the term of this patent is extended or adjusted under 35 U.S.C. 154(b) by 514 days.

(21) Appl. No.: 11/004,151

(22) Filed: Dec. 3, 2004

(65) Prior Publication Data

US 2005/0150990 A1 Jul. 14, 2005

Related U.S. Application Data

(60) Provisional application No. 60/535,979, filed on Jan. 12, 2004.

(51) Int. Cl.
*B65H 67/00* (2006.01)

(52) U.S. Cl. ..... 414/800; 414/331.1; 414/331.11; 414/663; 414/910; 414/911; 270/10; 242/533.7

(58) Field of Classification Search ..... 414/400, 414/655, 331.06, 656, 634, 659, 663, 664, 414/391, 395, 331, 331.03, 331.1, 331.11, 414/377, 396, 402, 668, 800, 910, 911, 18, 414/458–461; 270/52, 10; 242/533.7
See application file for complete search history.

(56) References Cited

U.S. PATENT DOCUMENTS

| | | | | |
|---|---|---|---|---|
| 3,383,867 | A * | 5/1968 | Ormerod | 405/293 |
| 4,129,293 | A * | 12/1978 | Schriber et al. | 270/52.1 |
| 4,402,642 | A * | 9/1983 | Klancnik et al. | 414/18 |
| 4,606,690 | A * | 8/1986 | Svendsen | 414/343 |
| 5,332,351 | A * | 7/1994 | Nelson et al. | 414/684 |
| 5,468,116 | A * | 11/1995 | Reichert et al. | 414/607 |
| 6,722,605 | B2 | 4/2004 | Joutsjoki | 242/533.7 |
| 7,056,076 | B2 * | 6/2006 | Ichikawa et al. | 414/226.04 |

FOREIGN PATENT DOCUMENTS

EP 1 272 416 B1 8/2005

OTHER PUBLICATIONS

Definition of "core" from www.thefreedictionary.com/core.*

* cited by examiner

*Primary Examiner*—Michael S Lowe
(74) *Attorney, Agent, or Firm*—Alix, Yale & Ristas, LLP

(57) ABSTRACT

In an apparatus for handling rolls of web material, a shaft bearing one or more fully wound rolls of web material thereon are supported from one end in a cantilever support. An external mandrel is aligned with a free end of the shaft. A roll-moving device is positioned to shift the rolls axially along the shaft away from the supported end of the shaft. The roll-moving device shifts the rolls of web material off the shaft and onto the aligned external mandrel, shaft or other support device. The weight of the roll of web material is borne by the shaft and external mandrel throughout the transfer. Once the shaft is removed, the rolls of web material can be handled during further processing from the core.

7 Claims, 8 Drawing Sheets

METHOD AND APPARATUS FOR HANDLING ROLLS FROM PAPER OR TISSUE MAKING MACHINE WITHOUT TOUCHING THE ROLL SURFACE

CROSS REFERENCE TO RELATED APPLICATIONS

This application claims the benefit of U.S. Provisional Application No. 60/535,979, filed Jan. 12, 2004.

BACKGROUND OF THE INVENTION

1. Field of the Invention

The present invention relates generally to the field of material handling and more specifically to the handling of rolls of web material wound on cores in web production equipment.

2. Description of the Related Art

Many products, such as paper, tissue, textiles, plastics, films or polymer webs are wound on cylindrical cores in the machine producing the product. In this application, the word "web" will be used to refer to these materials and is intended to encompass all materials of a width greater than 10 inches (254 mm) that are wound onto any type of cylindrical cores, shafts or the like. Typically, the cores are cylindrical paper, cardboard, plastic, metal or composite tubes supported for rotation on shafts (also referred to as spools) in the production equipment. The shaft and its fully wound roll or rolls of web material must be periodically removed from the production equipment and replaced with another shaft equipped with empty cores. The removed shaft is then separated from the rolls of web material, provided with empty cores and re-used.

Past methods of separating the shaft from the rolls of web material have involved using a shaft-extracting device or a roll-extracting device. Shaft extracting devices hold the roll of web material in place by setting it on the floor, platform, or like surface, then attaching an external device to the shaft and pulling the shaft out of the roll cores. Shaft extractors may be fixed, or adjustable in elevation. Setting the fully wound, heavy rolls onto a surface will cause deformations and contamination. Deformation is illustrated in FIG. 1.

The roll-extracting devices separate one or more rolls from a shaft by fixing the shaft in a support device, usually cantilevered. Once the shaft is in the support, the elevation of the shaft (and hence the rolls) is changed to rest the tissue/web on a cart, or the like. Setting the rolls onto the cart surface as shown in FIG. 1 can contaminate and deform the web material. The cart is then moved in the opposite direction, away from the fixed support of the shaft, and pulls the rolls axially off the shaft.

Significant losses in product are caused by wholly or partially supporting fully wound rolls of web material on their outside surface as shown in FIG. 1. The wound web is flattened by the weight of the product combined with the weight of the shaft used to support the roll in the production equipment. Further damage can occur if the rolls of web material are transported on conveyors or with clamp trucks. The costs associated with these common practices include product losses due to damaged web material and the lower speed and increased web breaks in downstream production equipment due to flattened or misshapen rolls of web material.

SUMMARY OF THE INVENTION

The present invention provides a new and improved method and apparatus for handling rolls of web material wherein damage to the rolls is avoided by supporting the rolls primarily from their cores.

According to aspects of the present invention, a shaft and one or more fully wound rolls of web material thereon are supported from one end in a cantilever arrangement. An external mandrel is aligned with a free end of the shaft. A roll moving device is positioned to shift the rolls axially along the shaft away from the supported end of the shaft. The roll moving device shifts the rolls of web material off the shaft and onto the external mandrel, spool or other support device. The weight of the roll of web material is borne by the shaft and external mandrel throughout the transfer. Once the shaft is removed, the rolls of web material can be handled via the core during further processing. The historical damage from upending, use of pallets, stacking, fork lift handling and clamp truck damage is eliminated because the roll of web material remains round.

In this method, the rolls of web material are primarily supported by the core and the circumferential surface of the wound rolls are wholly or substantially untouched. This method is applicable to any roll handling equipment and/or processes that partially support the rolls of web material from their outside surface.

Performance of the base invention may be enhanced by supporting the cantilevered shaft at its free end or at points between the cantilevered end and the free end. This may be accomplished by a connection between the mandrel and the free end of the shaft. Alternatively, the shaft may be supported from below as wound rolls are removed.

DETAILED DESCRIPTION OF PREFERRED EMBODIMENTS OF THE INVENTION

The major components of an apparatus for handling rolls of web material according to aspects of the present invention are: a cantilever shaft support 10; a roll moving device 20; and a movably supported external mandrel 30.

Figure 1:
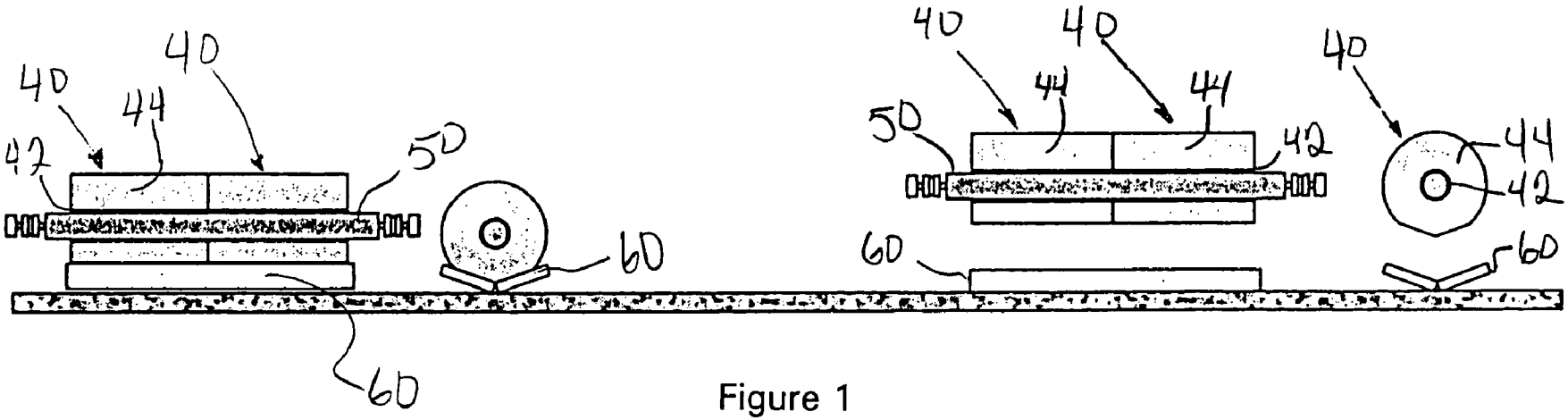
Figure 1 Prior Art
FIG. 1 illustrates a table used in a prior art roll extracting procedure and typical roll damage resulting from supporting the roll of web material on the table.
Figure 2:
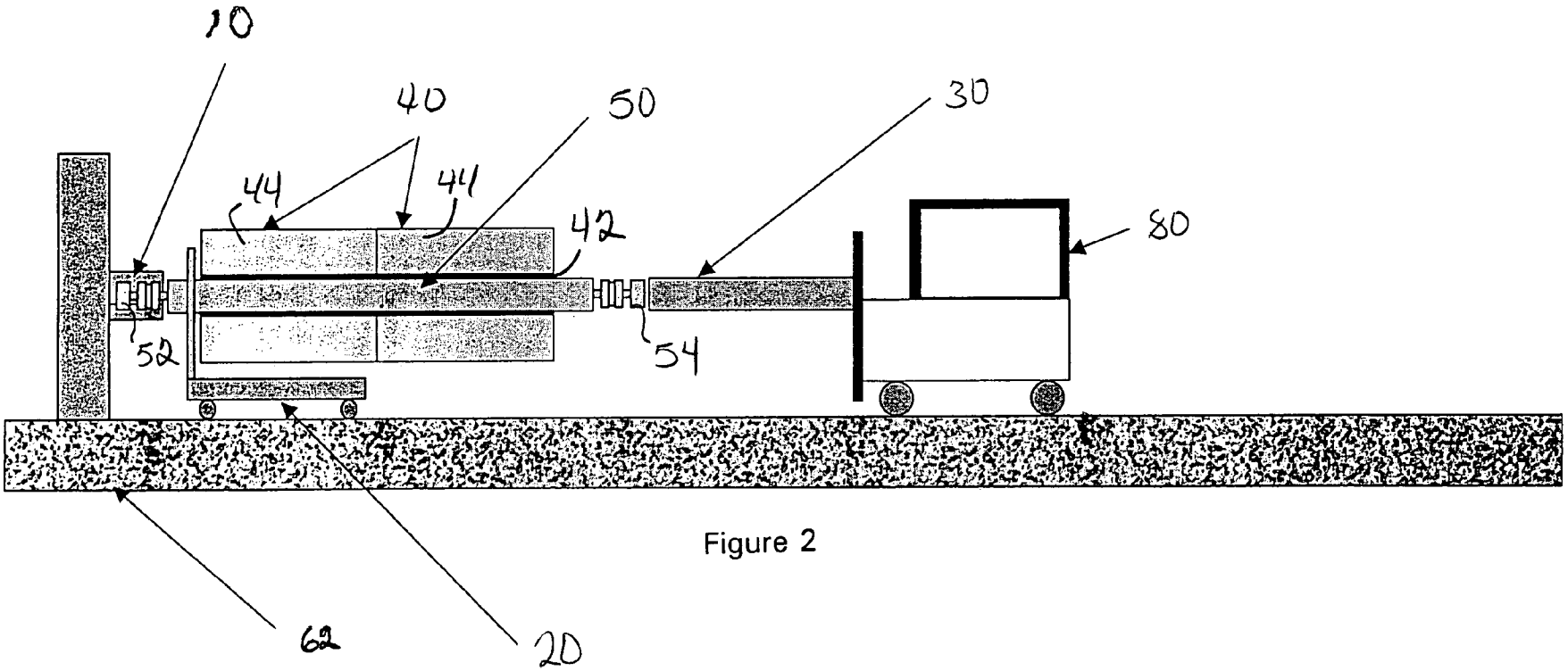
FIG. 2 is a side view of a roll handling apparatus according to aspects of the present invention in functional conjunction with a shaft bearing two rolls of web material.

The web material, whether paper, tissue, textile, plastics, films or polymer webs, is wound on cores of the machine producing the product. For the remainder of this specification, the term 'web' will be used to refer to all materials of a width greater than 10 inches (254 mm) that are wound onto any type of cylindrical cores, shafts, or the like. Web materials wound onto cylindrical cores result in rolls of web material 40 having a cylindrically shaped outside surface. FIG. 1 illustrates a common prior art situation where the shaft 50 from the production equipment and one or more fully wound rolls of web material 40 are placed on a table 60 or other surface for support while the shaft and rolls are separated. FIG. 1 illustrates the flattening of the wound web material caused by the combined weight of the rolls of web material 40 and the shaft 50 bearing on the outside surface of the rolls. Such flattening frequently interferes with the operation of machines used during subsequent processing or use of the web material. The flattening may be more pronounced in light weight products such as tissue.

Figure 3:
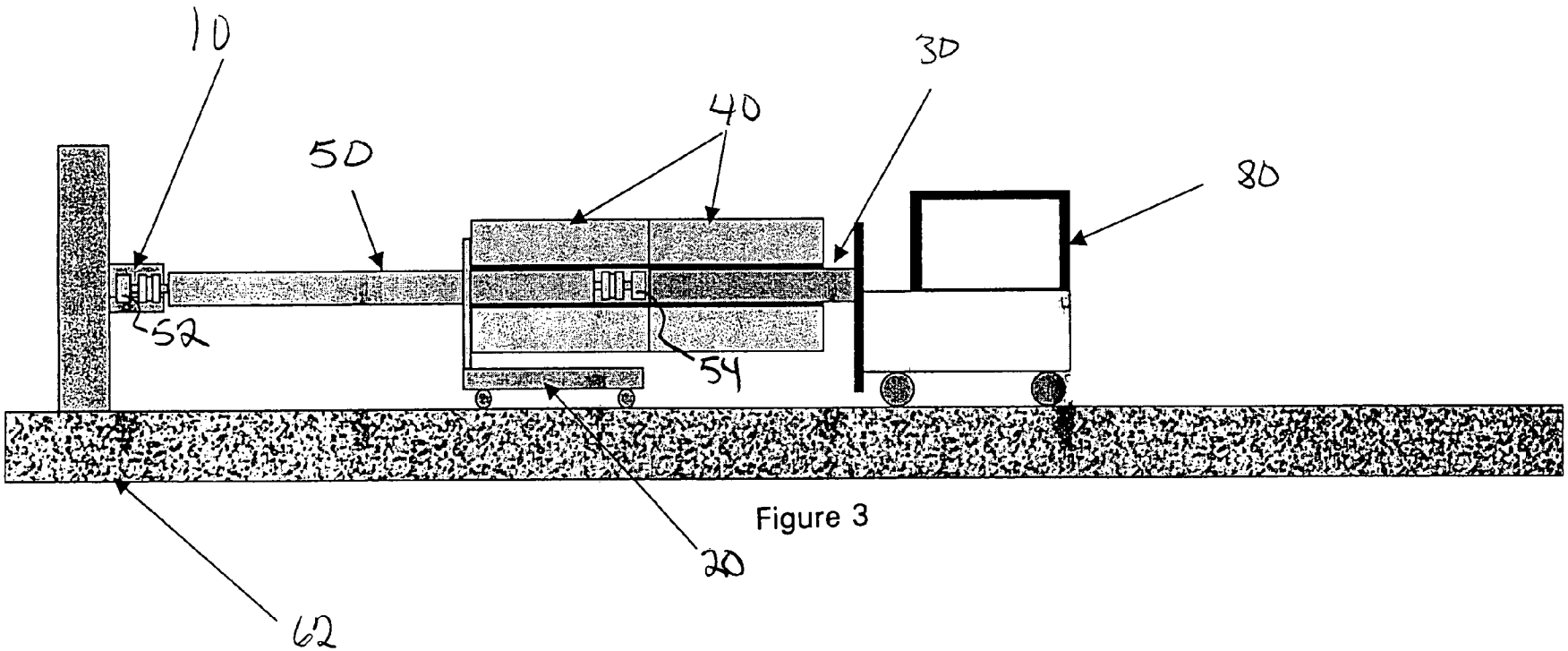
FIG. 3 shows the roll handling apparatus of FIG. 2 in the process of shifting a first roll onto an external mandrel according to aspects of the present invention.

FIGS. 2-7 illustrate a first embodiment of an apparatus for handling rolls of web material according to aspects of the present invention. One end 52 of the reel spool shaft 50, with rolls of web material 40 supported thereon is placed into a cantilever support 10. Each roll of web material 40 includes a core 42 and web material 44 wound on the core. Web material wound on a core will also be referred to as a "wound web 44." An external mandrel 30 is aligned with the free end 54 of the shaft 50. Alignment of the shaft 50 and external mandrel 30 may be accomplished by moving the external mandrel 30 relative to the shaft, or the cantilever support 10 may be changed in elevation to be aligned with the external mandrel 30. A roll-moving device 20 exerts an axial force against the end of the core 42 and/or wound web 44 in a direction away from the supported end 52 of the shaft 50. The rolls of web material 40 are moved along the shaft 50 until the roll of web material farthest from the cantilever support 10 is shifted onto the external mandrel 30, as illustrated in FIG. 3.

The axial force exerted by the roll-moving device may be a "pushing" force, for example between some fixed object adjacent the supported end 52 of the shaft and the rolls of web material 40. Alternatively, the axial force exerted by the roll-moving device may be a "pulling" force, for example exerted by the illustrated roll moving device 20 shown in FIGS. 2-7.

Figure 4:
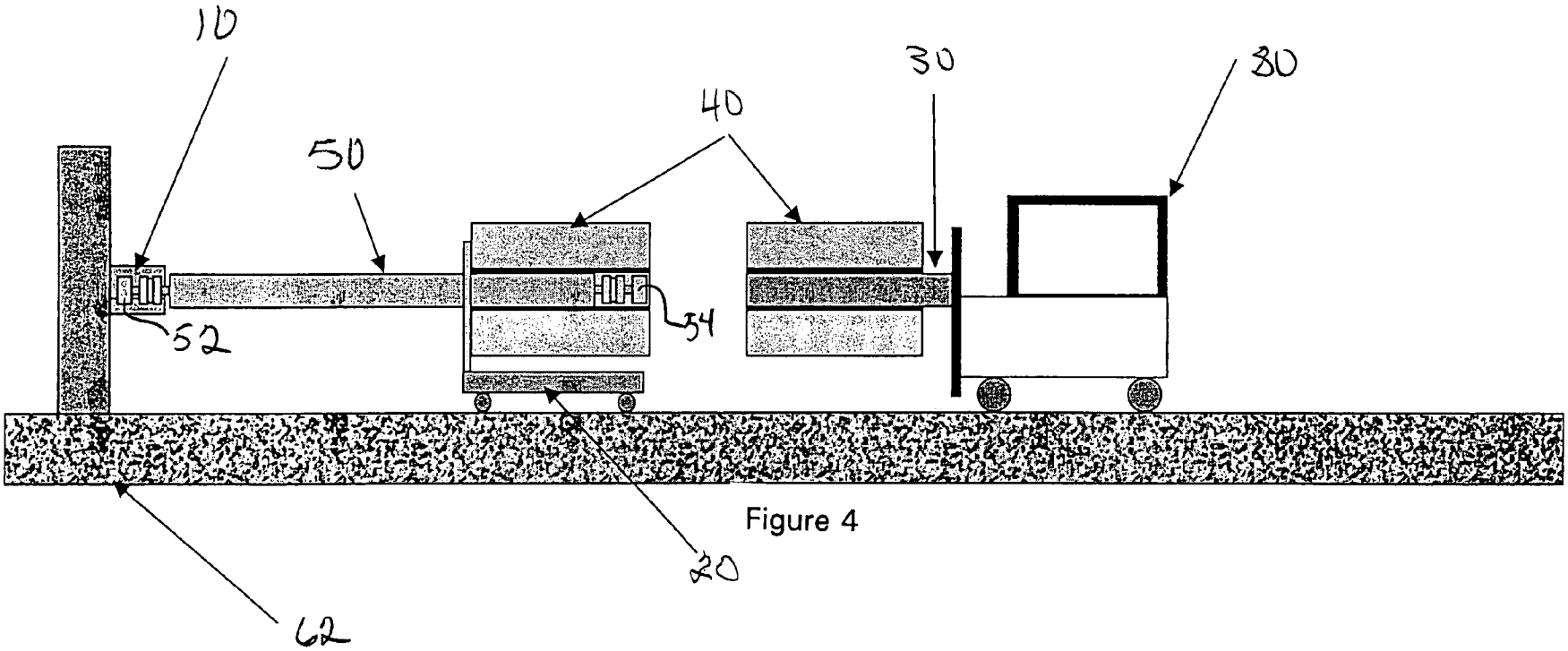
FIG. 4 shows the roll handling apparatus of FIG. 3 with the first roll supported by the external mandrel and being moved away from the shaft and second roll.

The external mandrel 30, now bearing a roll of web material 40, is moved away from the free end 54 of the shaft and any remaining rolls on the shaft, as illustrated in FIG. 4. The external mandrel 30 is taken to another location, for storage, staging or further processing. The mechanism 80 to move the external mandrel 30 to another location may be by vehicle (fork lift, tow motor or the like), by cart, trolley, automatic guided machines or any like transportation method. The external mandrel 30 is illustrated as supported by a lift truck-type vehicle 80. The external mandrel 30 may alternatively be supported by a vehicle of any type, including but not limited to a crane, a cart, a trolley. The external mandrel 30 may also be incorporated into a stand for staging the rolls of web material 40.

Figure 5:
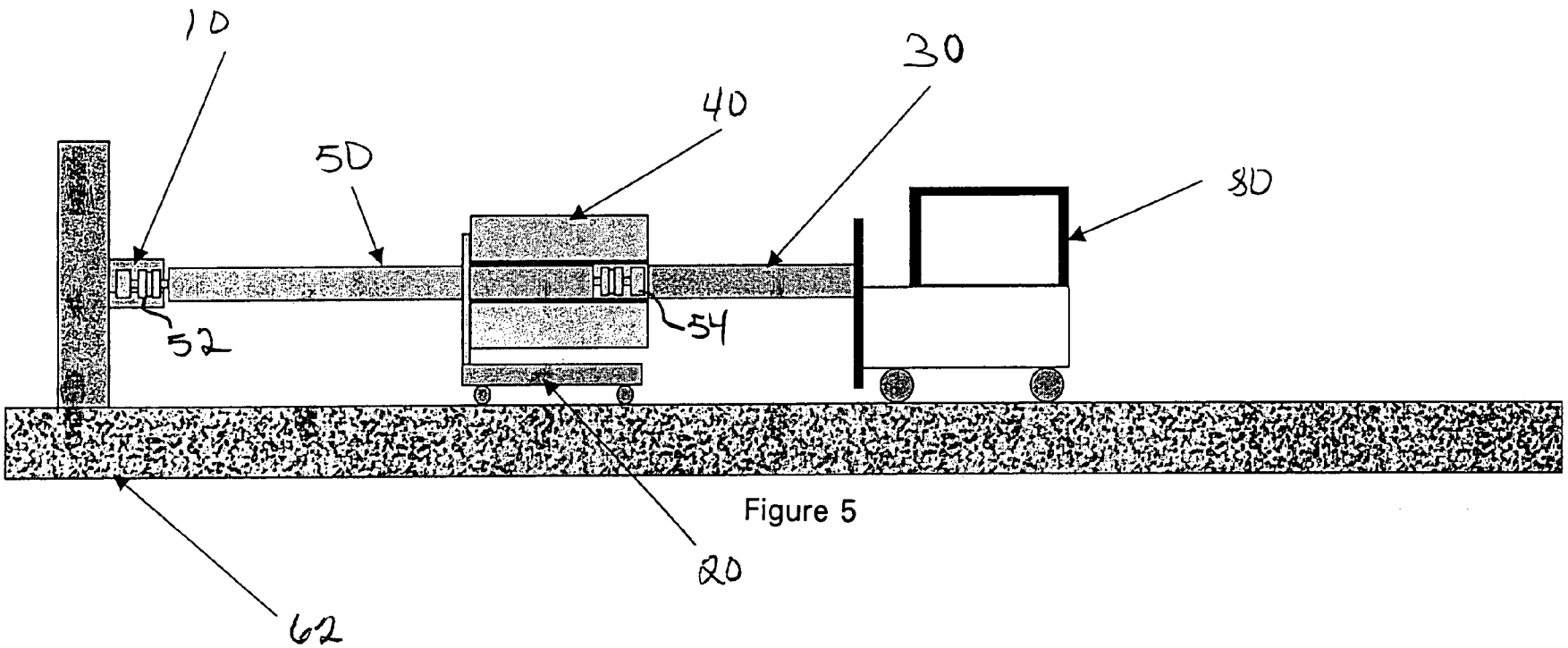
FIGS. 5-7 illustrate shifting and removal of the second roll from the roll handling apparatus of FIG. 6 according to aspects of the present invention.
Figure 6:
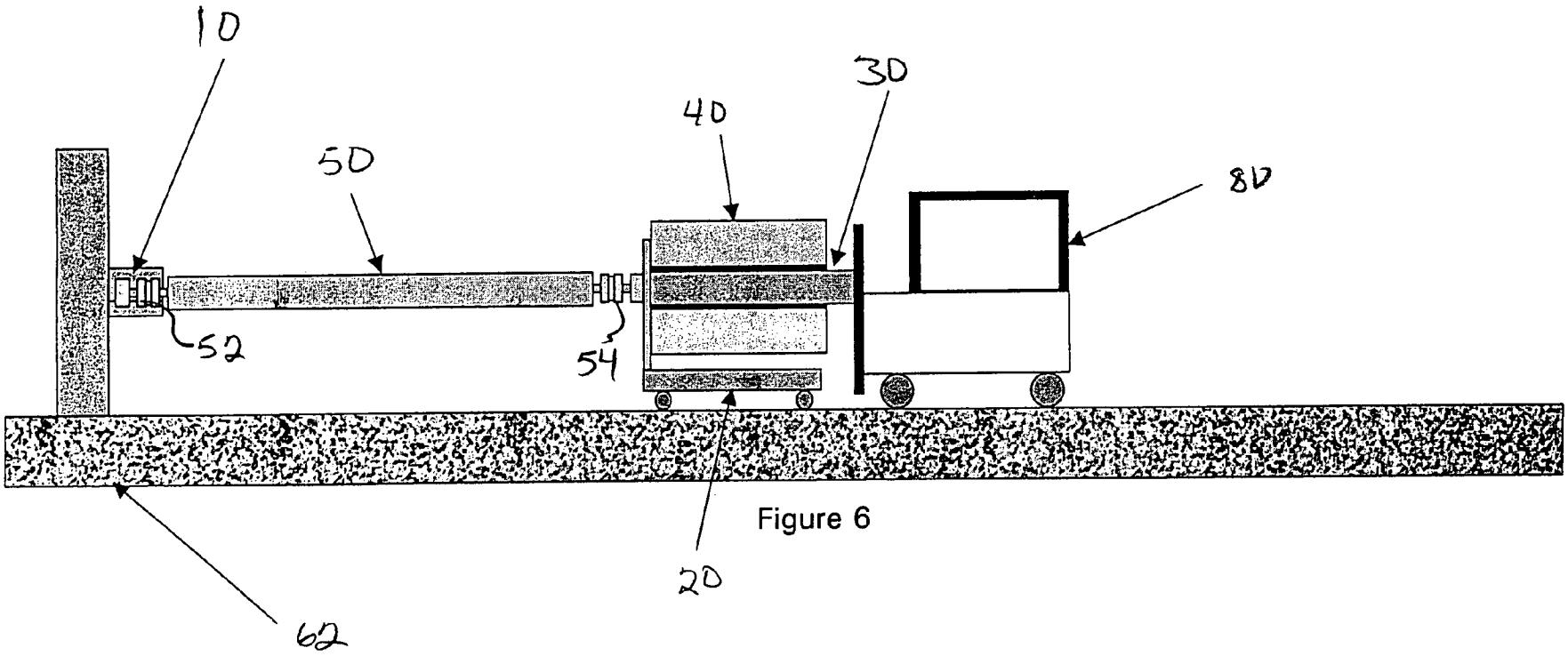
Figure 7:
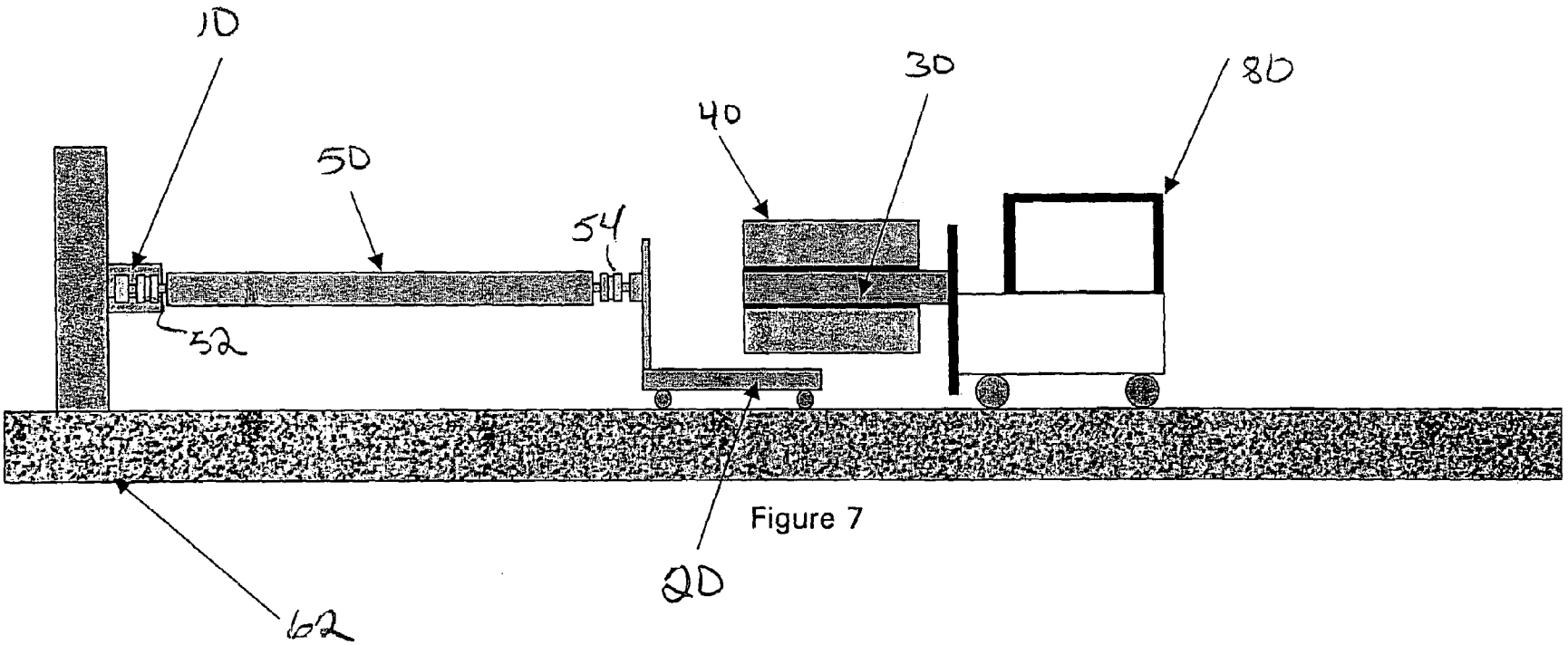

The next empty mandrel 30 is aligned with the free end 54 of the shaft, and any remaining rolls of web material 40, as illustrated in FIG. 5. The roll moving device 20 presses against the end of the core 42 and/or wound web 44 to shift the next roll of web material 40 along the shaft 50 until the roll is shifted onto the external mandrel 30, as illustrated in FIG. 6. The external mandrel 30, now bearing a roll of web material 40, is moved away from the shaft 50, as shown in FIG. 7. This process is repeated until all rolls of web material 40 are transferred from the shaft 50 to external mandrels 30.

Figure 8:
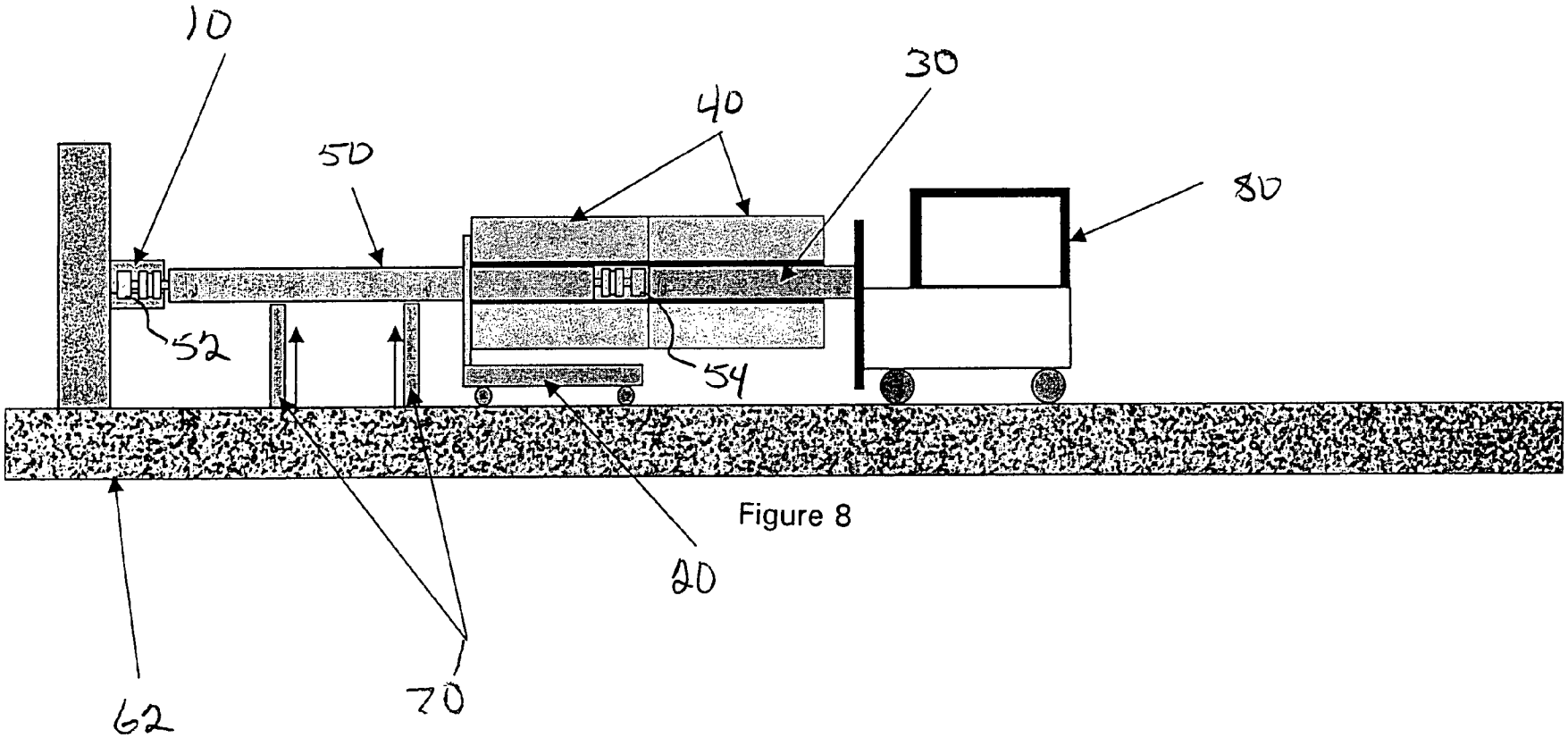
FIG. 8 is a side view, partially in section, of an alternative embodiment of a roll handling apparatus according to aspects of the present invention.

The apparatus illustrated in FIGS. 2-7 may be augmented with external supports 70 for the cantilevered shaft 50 as shown in FIG. 8. As the rolls of web material 40 are moved away from the cantilever support 10, their leverage on the supported end 52 of the shaft increases. The supports 70 rise, manually or automatically, as the web passes each support point to reduce the bending stress experienced by the shaft 50. The external supports 70 are configured to rise from the floor 62 to abut the exposed shaft 50 for added support. The external supports 70 may be powered by any means, including but not limited to electricity, mechanical, fluid, gas or any suitable combination thereof.

Alternatively, the roll moving device 20 may be configured to provide support to the shaft 50 as it moves the rolls of web material 40. The illustrated cart-like roll moving device 20 is an example of one type of roll moving device. The roll moving device 20 may be of any type and powered by any means, including but not limited to all fluids (liquid or gas) and electric devices such as motors. The roll moving device 20 may be configured to push or pull the rolls of web material 40. The roll moving device preferably exerts an axial force against the core 42 and/or the wound web 44 to shift the rolls along the shaft 50.

The rolls of web material are typically stored or staged in racks, rails, stands or the like prior to further processing in converting equipment (not shown). Additional external mandrels may be provided for use in the next operation. The additional external mandrels may be provided with at least one bearing housing (or core chuck, or equivalent, not shown) on the end after the roll of product has been placed upon it. This method extends to include the addition of a bearing (or core chuck, or equivalent, not shown) on both ends of the external mandrel after the roll of product has been placed upon it.

An enhancement to the performance of the base invention, although not absolutely required for performance, is using a mandrel configured to function as the core support, or reel spool (unwinding shaft) used in the next operation, whether the operation is an unwinding operation, or a storage operation. Therefore, once transferred from the shaft 50 to the external mandrel 30, the roll of web material 40 will remain on this mandrel for the next operation (storage, unwinding, or the like). An additional transfer of this fully wound roll 40 off the external mandrel is not required. The mandrel design may be used as-is, or may have one or more bearings and/or bearing housings added to perform the next operation. However, the wound web remains on the mandrel.

Another enhancement to the performance of the base invention, although not absolutely required for performance, is using a support device (not shown) on the free end 54 of the shaft. This support would hold part of the weight of the shaft 50 and the rolls of web material 40. Once the external mandrel 30 is aligned with the shaft 50, this support would be removed from the free end 54 of the shaft so a roll of web material can be shifted onto the external mandrel. Engaging the mandrel 30 to the free end 54 of the shaft and having the mandrel support may provide a variation of this support. If the mandrel is used as the support, it may, or may not, be retracted during the roll shifting process.

Yet another enhancement to the performance of the base invention, although not absolutely required for performance, is re-installing empty cores 42 onto the empty shaft 50. The basic apparatus as described above may be supplemented by equipment (not shown) to manually or automatically install cores on the now empty shaft. The shaft may then be placed back into the production machine to wind more of the web product onto the new cores. This enhancement involves bringing empty cores to the reel spool shaft with an external vehicle, such as a cart or the like, or from machinery raising from the floor, or lowering from above, or moving to the shaft from the sides. Pushing devices (not shown), mounted on or near the vehicle used to bring the cores to the empty reel spool, will move the empty cores onto the shaft toward the cantilever support. These pushing devices will press one or more cores on to the shaft at a time, until all the desired cores are on the shaft. The shaft, now carrying empty cores, is removed from the cantilever support by crane or other lifting device, and manually or automatically placed into the machine for winding.

While exemplary embodiments of the foregoing invention have been set forth for purposes of illustration, the foregoing description should not be deemed a limitation of the invention herein. Various modifications, adaptations and alternatives may occur to one skilled in the art without departing from the spirit and the scope of the present invention.

What is claimed is:

1. A method for transferring rolls of web material wound on a production core and supported by a production reel spool shaft extending through said core, said shaft having first and second ends extending beyond said core, said method comprising:

removing one of said rolls including said shaft with said core and said wound web material, from production equipment;

supporting said shaft of said removed roll only at one of said first or second ends;

aligning a mandrel with the other of said first or second ends;

while said shaft is supported only at said one end, moving said roll axially along said shaft toward said mandrel;

continuing to move said roll off said shaft onto said mandrel;

wherein the roll of web material is supported exclusively at the core throughout transfer from said shaft to said mandrel.

2. The method of claim 1, wherein said steps of aligning and moving are repeated for each roll of web material supported by said shaft.

3. The method of claim 1, wherein said step of moving comprises applying an axial force to an end of said core and/or web material facing the supported first or second end, said axial force directed to move said roll of web material away from said supported end.

4. The method of claim 1, wherein while said shaft is supported only at said one end and the roll has been moved axially along said shaft toward said mandrel but before said roll has been moved off said shaft onto said mandrel, additionally supporting said shaft from below in at least one other support position intermediate said first and second ends during said step of moving said roll off said shaft.

5. The method of claim 1, wherein the roll moving device is a wheeled cart translatable parallel to the axis of the shaft from a first position below said supported one end of the shaft to a second position below said mandrel.

6. The method of claim 1, wherein the mandrel is supported by and movable with a wheeled cart, whereby a mandrel with roll moved thereon from said shaft can be wheeled away.

7. The method of claim 1, wherein the mandrel is supported by and movable with a wheeled cart, whereby a mandrel with roll moved thereon from said shaft can be wheeled away.

* * * * *